United States Patent [19]

Sonneville

[11] Patent Number: 4,991,372

[45] Date of Patent: Feb. 12, 1991

[54] ASSEMBLY OF REINFORCING BARS AND CLIP

[75] Inventor: Roger P. Sonneville, Annapolis, Md.

[73] Assignee: Sonneville International Corporation, Washington, D.C.

[21] Appl. No.: 437,434

[22] Filed: Nov. 16, 1989

[30] Foreign Application Priority Data

Nov. 17, 1988 [FR] France ..... 88 14948

[51] Int. Cl.[5] ..... E04C 5/16

[52] U.S. Cl. ..... 52/685

[58] Field of Search ..... 52/683, 684, 685, 686, 52/687, 688, 689, 677, 652

[56] References Cited

U.S. PATENT DOCUMENTS

| | | | |
|---|---|---|---|
| 1,024,260 | 4/1912 | Hickman | 52/687 |
| 2,407,249 | 9/1946 | Burner . | |
| 3,004,370 | 10/1961 | Tinnerman | 52/686 |
| 3,673,753 | 7/1972 | Anderson . | |
| 4,835,934 | 6/1989 | Swenson | 52/687 |

FOREIGN PATENT DOCUMENTS

| | | | |
|---|---|---|---|
| 0021960 | 7/1981 | European Pat. Off. . | |
| 848696 | 9/1949 | Fed. Rep. of Germany . | |
| 1271355 | 10/1960 | Fed. Rep. of Germany . | |
| 3412880 | 10/1985 | Fed. Rep. of Germany | 52/687 |
| 2114993 | 7/1972 | France . | |
| 2128485 | 10/1972 | France . | |
| 2410102 | 6/1979 | France . | |
| 1004900 | 9/1965 | United Kingdom . | |

*Primary Examiner*—John E. Murtagh

*Attorney, Agent, or Firm*—Wenderoth, Lind & Ponack

[57] ABSTRACT

According to the invention, reinforcement bars (1; 11; 21; 22) which are usually welded, are assembled by means of clips (30) which are elastically clipped in position at the nodes formed by the bars (2, 12, 21).

These clips also perform a spacing function when the reinforcements are placed in position in the moulds employed for manufacturing reinforced concrete products.

Application in particular in the manufacture of reinforced concrete ties.

12 Claims, 3 Drawing Sheets

ASSEMBLY OF REINFORCING BARS AND CLIP

The present invention relates to a fastener or clip for assembling reinforcement elements for a reinforced concrete structure. The invention may be applied in particular to reinforcements which must be incorporated in concrete ties or sleepers, and it also relates to a method for manufacturing such ties and to the resulting products.

A method for manufacturing railway ties or other products of reinforced concrete is known, in which the reinforcement and the concrete are placed in position in a mould which is open in its upper part, the stripping from the mould being effected by inversion of the mould.

Experience has shown that it is advantageous in such a method to completely fill the mould with concrete up to its upper horizontal face, then to cause the reinforcement to penetrate this concrete during the vibration, under the pressure of a tamping mass which exerts a thrust on the reinforcement through spacer members at the same time as it terminates the free surface of the concrete which will constitute the lower face of the tie after stripping from the mould.

This positioning of the reinforcement by penetration in the vibrating concrete becomes difficult if, on one hand, the bars of this reinforcement are numerous and consequently close together in a given horizontal plane and if, on the other hand, the composition of the concrete includes a large proportion of large aggregates which is desirable for improving its resistance to abrasion by the ballast. It is consequently advantageous to reduce the number of bars loted in the same horizontal plane, and to construct a reinforcement of which all or a part of the main bars are grouped in pairs, placed one above the other in parallel relation in the same vertical plane, these bars being spaced apart from each other by transverse bars placed therebetween so as to permit a complete coating and a good anchoring of the reinforcement in the concrete. Such a reinforcement consequently has a number of nodes of three bars which have in plan a cross or T shape and which must be assembled.

Such an assembly has been achieved heretofore by welding. Now, welding, and in particular electric resistance welding carried out by welding presses, weakens the reinforcements. On one hand, it crushes the bars and reduces the section at the assembly points. On the other hand, serrated steels having a high elastic limit required for imparting to railway ties the required resistance to fatigue under repeated deflections, have their properties affected by the weld: they become fragile if they have a high carbon content or they lose a part of their strength by annealing under the effect of the weld. This type of assembly by welding is therefore undesirable. Furthermore, it is costly and requires considerable investments as concerns equipment and power supply.

An object of the invention is therefore to solve this problem and to provide a means for assembling reinforcement bars which does not require welding, and is easy to carry out while being reliable and relatively cheap. Another object of the invention is to facilitate the manufacture of railway ties or other reinforced concrete products while reducing the costs.

For this purpose, the invention mainly provides a fastener or clip for assembling at least two parallel bars separated by a third bar extending transversely between the first two bars so as to to form a cross-shaped or T-shaped assembly node, wherein the clip is made from an elastically deformable material and has the general shape of a C comprising a back portion and two curved end portions defining confronting concave inner surfaces, said concave surfaces being adapted to cooperate by an elastic clipping with the two parallel bars, a part of the back portion and one of the curved end portions constituting a fork adapted to straddle the transverse bar.

According to other features:

the other curved end portion of the clip includes an outwardly projecting extension extending substantially in a direction parallel to the back portion of the C;

the first curved end portion constituting a fork comprises two branches at least one of which is extended by an extension which extends substantially perpendicularly to the orientation of the back portion of the C;

the end of the other curved end portion of the clip also defines a fork allowing the passage of the transverse bar;

the clip is preferably moulded in a plastics material.

The invention also provides a reinforcement formed by a plurality of bars so arranged as to form at least one cross or T-shaped node between two parallel bars separated by a third bar which extends transversely relative to the first two bars, wherein said different bars are assembled by means of at least one clip such as defined hereinbefore.

The invention also provides a method for manufacturing a railway tie or other reinforced concrete product, comprising employing a mould having the shape of the product and open in its upper part, placing concrete in said mould, vibrating it, causing at least one reinforcement to penetrate the concrete during the vibration under the pressure exerted by a tamping mass which exerts a thrust on the reinforcement through spacer members, then stripping the product from the mould by turning the mould over, wherein the reinforcement comprises a plurality of bars assembled by means of clips according to the invention, said clips simultaneously performing the function of spacers.

Preferably, the spacer-clips perform this function, on one hand relative to the tamping mass, and, on the other hand relative to at least one lateral face of the mould.

The invention lastly provides a railway tie or other product obtained by the previously-defined method.

The invention will be described in more detail hereinafter with reference to the accompanying drawings which are given solely by way of example and in which.

Figure 1:
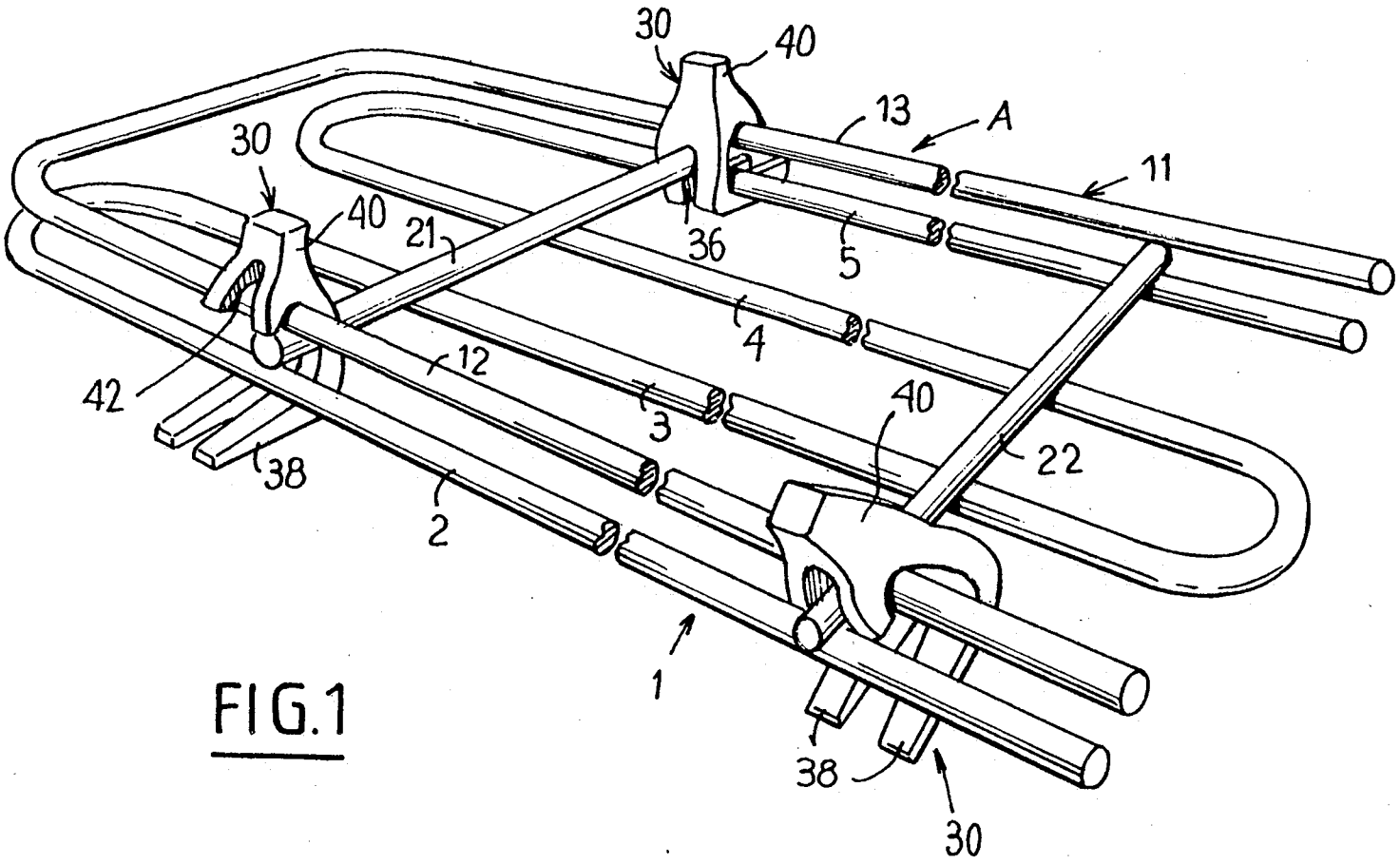
FIG. 1 is a perspective view of a reinforcement whose various bars are assembled by means of clips according to the invention.

FIG. 1 shows a reinforcement which may be used in a reinforced concrete tie or sleeper. This reinforcement is composed of a lower zig-zag reinforcement 1 having four parallel longitudinal bars 2, 3, 4, 5, and an upper U-shaped reinforcement 11 comprising two parallel longitudinal bars 12, 13 located in the same vertical plane as the two end bars 2, 5 of the lower reinforcement, and rectilinear transverse reinforcements 21, 22 disposed between the two lower and upper reinforcements and extending transversely relative to the longitudinal bars of the latter reinforcements.

Disposed in a region of the cross-shaped or T-shaped nodes formed by the bars 2, 12 and 5, 13 are fasteners or clips 30 according to the invention.

Figure 2:
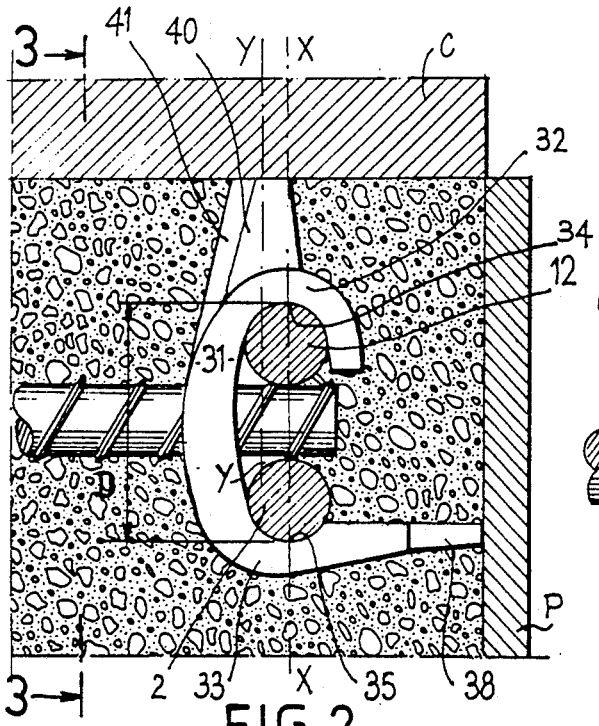
FIG. 2 is a sectional view taken in a plane perpendicular to two parallel bars assembled by the clip.

Each clip is moulded from a plastics material and has a generally C shape (FIG. 2). This C comprises an intermediate or back portion 31 and an upper end portion 32 and lower end portion 33 defining confronting concave inner surfaces 34, 35. The radius of these concave surfaces is substantially equal to the radius of the main bars 2, 4 and the distance therebetween D is slightly less than or substantially equal to the height or total thickness of the three bars 2, 12, 21 clamped together.

Figure 3:
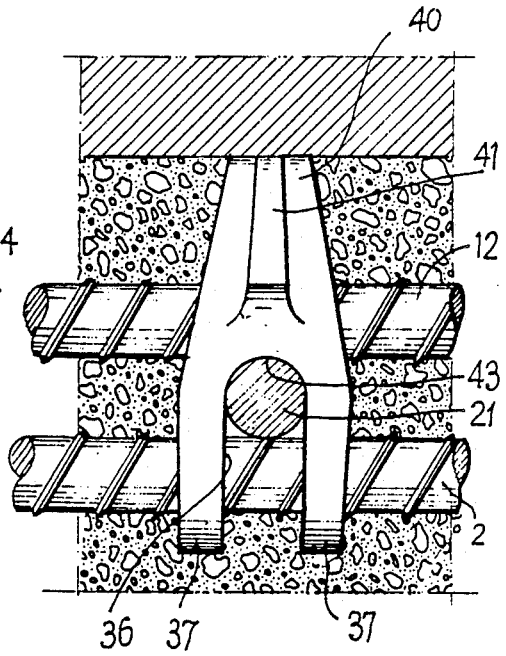
FIG. 3 is a sectional view taken on line 3—3 of FIG. 2.
Figure 4:
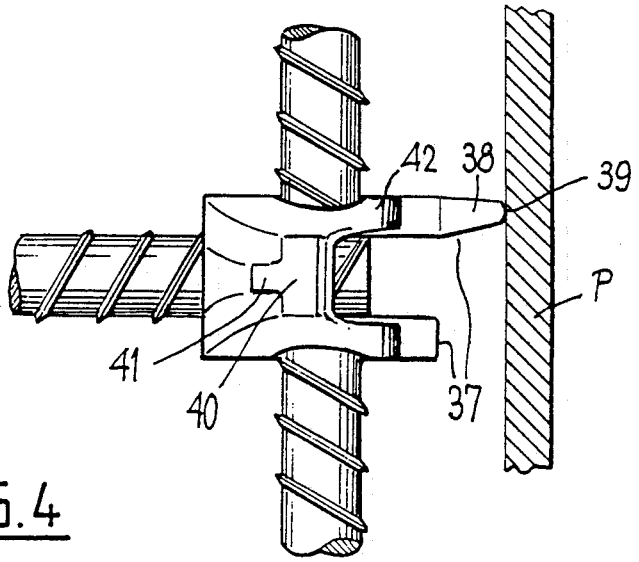
FIG. 4 is a plan view of the arrangement of the reinforcement bars the assembling clip and the lateral wall of the mould.

The intermediate portion 31 and the lower end portion 33 of the clip shown in FIG. 1 or FIG. 3 have the shape of a fork 36 so as to be capable of straddling the transverse bar 21. The lower end of the clip thus comprises two branches 37, at least one of which is extended to form a spacing extension 38 (FIG. 4) which extends substantially in a direction perpendicular to the back portion 31 and whose end 39 is adapted to come into contact with a lateral wall P of the mould (FIGS. 2 and 4). The upper surface of the or each extension 38 is connected to the adjacent portion of the C at a level which is a few millimeters (for example 3 mm) higher than the level of the tangent to the bottom of the concave surface 35.

The upper end 32 of the C includes another extension 40 which is in one piece therewith and extends roughly in a direction parallel to the intermediate portion of the C, i.e. vertically upwardly when the clip is in position on a reinforcement as represented in FIG. 1 or FIG. 2. This extension also acts as a spacer member and is adapted to cooperate with a tamping mass C, as will be explained hereinafter. It is preferably ribbed (at 41) in order to be sufficiently strong.

The upper end of the C also terminates preferably in a portion 42 defining a fork to permit the positioning of the fastener as will be described hereinafter.

Figure 7:
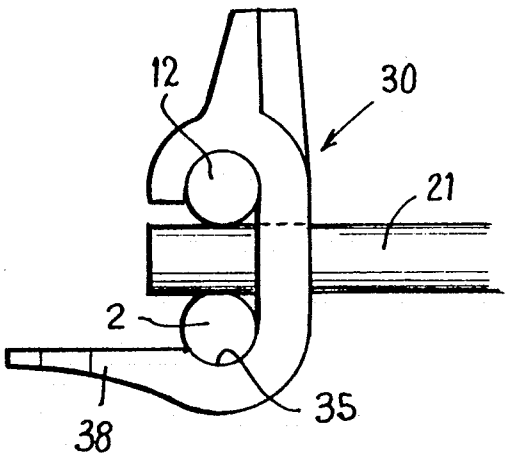
FIGS. 5, 6 and 7 are three views illustrating the positioning of a clip on reinforcement bars.
Figure 6:
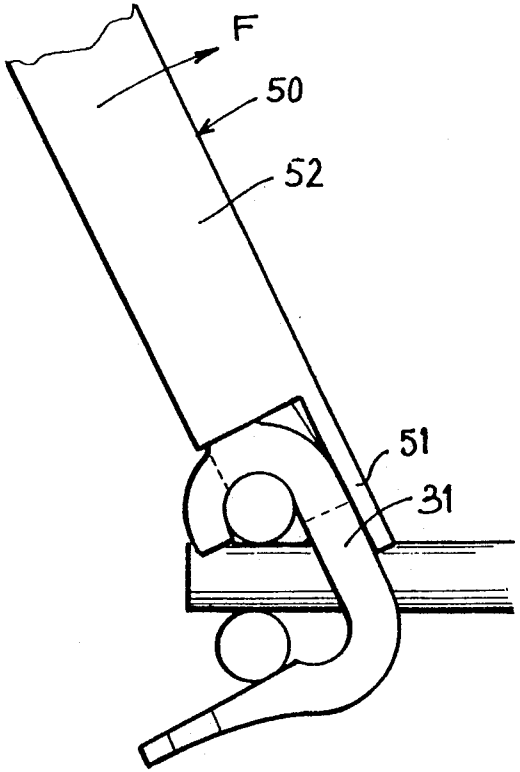
Figure 5:
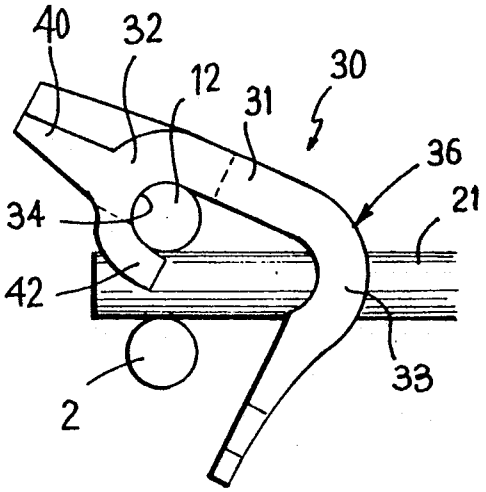

A clip is placed in position on a reinforcement node constituted by two longitudinal bars separated by a transverse bar, as shown in FIGS. 5 to 7. The clip is first of all disposed on the upper bar 12 so that the inner concave surface 34 of the upper end portion of the C comes in contact with this upper bar, the clip being inclined so that the transverse bar 21 extends within the forks 36, 42 defined by the two end portions of the C.

There is then adapted on the upper part of the clip, and in particular on the lug 40, a very simple tool which consists of a lever 50 and includes a notched tab 51 which comes to bear against the back portion of the clip and a hollow handle 52 in which the lug 40 is engaged. This lever is pivoted in direction of arrow F (FIG. 6) so as to elastically deform the lower portion of the clip and bring the latter to the position of FIG. 7 in which it assembles the three bars.

By choosing for the construction of this clip a plastics material which has good elastic properties but is chemically inert to resist the action of the cement, such as a high-density polyethylene, and by judiciously dimensioning the back portion of the C and the distance between the end portions of the clips, the assembly is subjected to an elastic clamping force which is sufficient to oppose any displacement of the three bars when handling and placing the reinforcement in the concrete in the course of the vibration. In particular, the difference of level of a few millimeters between the or each extension 38 extending the lower branches of the clip and the concave surface 35 ensures a clipping action and prevents the lower main bar 2 from leaving the cavity therefor.

In a particularly interesting application, the clip-spacer according to the invention is employed in the course of the manufacture of railway ties, as illustrated in FIGS. 2 to 4. A reinforcement such as shown in FIG. 1 is then employed whose end longitudinal reinforcements are assembled by means of four clip-spacers according to the invention, only three of which are shown in the drawing.

In FIG. 1, the reinforcement is shown in the position it occupies when it is placed in position in the mould. The latter is only shown by one of its lateral walls P in FIGS. 2 and 4; it may for example have the shape of a rectangular-sided structure, or a truncated pyramid whose open side, of larger section, faces upwardly. This mould is first of all filled with concrete. The latter is subjected to a vibration. The reinforcement is introduced in the concrete in the course of the vibration by using a tamping mass C which bears against the upper end of the extensions 40 of the clips. It will be understood that the length of these upper spacer-extensions corresponds to the required thickness of the concrete overlying the reinforcement.

Note that the force exerted on the spacer-clips tends to close these C-shaped clips since the three reinforcement bars and the substantially horizontal extension or extensions 38 extending the lower part of each clip and acting as a lever, are subjected to an upward reaction due to the resistance of the concrete when the assembly enters the latter. Furthermore, if serrated bars are used, the projecting ribs slightly enter the plastics material of the clip and thus oppose any relative displacement of the bars.

When the reinforcements are placed in position, the lower extensions 38 perform the function of passive spacers which guide the reinforcement relative to the lateral wall of the mould.

Detail arrangements are morover provided to ensure that, during the penetration of the reinforcement in the concrete, the upper extension 40 does not have a tendency to pivot. For this purpose, on one hand, the vertical axis Y—Y of the extension 40 is offset relative to the vertical axis X—X of the longitudinal bars in the direction away from the wall of the mould. Furthermore, as clearly shown in FIG. 3, the fork defined by the back portion of the C terminates in its upper part in a rounded part 43 whose center and radius substantially coincide with those of the transverse bar 21.

The advantages afforded by the invention are clear from the foregoing description:

the clip-spacer achieves a reliable assembly at the nodes of three bars which permits avoiding welds;

this clip moulded from a plastics material is easy to manufacture and relatively cheap, which results in substantial savings relative to the investments in welding presses and their supply of electric power;

the function of positioning the reinforcement in the mould is performed effectively owing to the upper spacer-extensions and lateral spacer-extensions.

I claim:

1. In an assembly comprising at least two bars which are parallel to each other and a third bar extending transversely between the first two bars so as to form a cross-shaped or T-shaped assembly node, the improvement comprising a clip made from an elastically deformable material having the general shape of C comprising a back portion and two curved end portions defining confronting concave inner surfaces, said concave surfaces being adapted to cooperate by an elastic clipping with the two parallel bars, a part of the back portion and a first of the curved end portions constituting a fork adapted to straddle the transverse bar.

2. An assembly according to claim 1, wherein the other curved end portion of the clip includes a first outwardly projecting extension extending substantially in a direction parallel to the back portion of the C.

3. An assembly according to claim 2, wherein said first extension includes at least one reinforcing rib.

4. An assembly according to claim 1, wherein said other curved end portion of the clip defines a fork.

5. An assembly according to claim 1, wherein said first curved end portion constituting a fork comprises two branches at least one of which is extended by a second extension extending substantially perpendicularly to the direction of the back portion of the C.

6. An assembly according to claim 5, wherein the upper surface of said second extension is connected to the adjacent curved end portion of the C at a level which is a few millimeters higher than the level of a tangent to the bottom of the adjacent concave surface.

7. An assembly according to claim 1, wherein said clip is moulded in a plastics material.

8. An assembly according to claim 5, wherein said first extension is offset relative to the axis of the longitudinal bars in a direction opposed to the direction in which the second extension extends.

9. A reinforcement assembly comprising a first zigzag reinforcement element comprising four longitudinal parallel bars, a second U-shaped reinforcement element comprising two parallel longitudinal bars disposed in the same vertical planes as the two end bars of the first reinforcement element, and at least two transverse bars disposed between the first and second reinforcements, said reinforcement elements and said bars forming four cross-shaped or T-shaped assembly nodes, a clip being provided at each of said four assembly nodes, which is made from an elastically deformable material and has the general shape of C comprising a back portion and two curved end portions defining confronting concave inner surfaces, said concave surfaces being adapted to cooperate by an elastic clipping with one of said end longitudinal bars of the first reinforcement element and with the adjacent longitudinal bar of the second reinforcement element, a part of the back portion and a first of the curved end portions constituting a fork adapted to straddle the transverse bar.

10. A reinforcement assembly according to claim 9, wherein the other curved end portion of the clip includes a first outwardly projecting extension extending substantially in a direction parallel to the back portion of the C.

11. A reinforcement assembly according to claim 9, wherein said first curved end portion constituting a fork comprises two branches at least one of which is extended by a second extension extending substantially perpendicularly to the direction of the back portion of the C.

12. A reinforcement assembly according to claim 11, wherein said first extension is offset relative to the axis of the longitudinal bars in a direction opposed to the direction in which the second extension extends.

* * * * *